United States Patent [19]

Woodruff

[11] 4,170,734

[45] Oct. 9, 1979

[54] ENERGY REGULATOR

[75] Inventor: Royston F. Woodruff, Maidenhead, England

[73] Assignee: E M I Limited, Middlesex, England

[21] Appl. No.: 857,520

[22] Filed: Dec. 5, 1977

[51] Int. Cl.[2] ..... H05G 1/00

[52] U.S. Cl. ..... 250/402; 250/408; 250/418

[58] Field of Search ..... 250/402, 403, 401, 405, 250/408, 409, 413, 417, 418, 421

[56] References Cited

U.S. PATENT DOCUMENTS 3,828,194 8/1974 Grasser ..... 250/408

*Primary Examiner*—Craig E. Church
*Assistant Examiner*—Thomas P. O'Hare
*Attorney, Agent, or Firm*—Fleit & Jacobson

[57] ABSTRACT

An electrical energy regulator, particularly suitable, for a portable X-ray machine. A transformer primary of a converter is supplied with half waves of a.c. via a transistor whose conduction interval during each half-wave is controllable to regulate the peak voltage applied, after cut off of primary current, by induction from a tuned circuit formed with the primary to an X-ray tube connected to a secondary winding of the transformer.

9 Claims, 3 Drawing Figures

ENERGY REGULATOR

This invention relates to an X-ray apparatus.

Certain X-ray appliances, particularly portable ones weighing eg 20 to 150 lbs., require an energy regulator to enable the X-ray quality, i.e., wavelength, to be adjusted to a particular value which is then to be maintained. The quality is determined by the peak value of the X-ray tube voltage.

On alternating current it is possible to regulate the energy supply with a continuously variable ratio transformer, e.g. the VARIAC (Registered Trade Mark) type. This device does not greatly alter the waveform of the alternating current but it is relatively bulky and heavy and requires a moving contact which must carry the full load current. Also, automatic control involves a motor to operate the transformer.

It is an object of the invention to provide an X-ray apparatus in which the magnitude of the electrical energy applied to the X-ray tube is controllable by electronic means.

X-ray apparatus comprising an input for receiving AC electrical energy; a rectifier for receiving the AC electrical energy; pulse producing means connected to the rectifier to produce from the unidirectional half-waves of electrical energy supplied thereby undirectional pulses of electrical energy having controlable durations; control means connected to the pulse producing means to control the durations of the pulses; an X-ray tube having the electrical characteristics of a diode; and tube energising means comprising a resonant circuit which is arranged to resonate at a frequency at least twice that of the AC electrical energy and which includes a transformer having a primary winding connected to receive the pulses and a secondary winding connected to the X-ray tube, the tube energising means being arranged to store the energy of each pulse in such manner that the voltage applied to the X-ray tube during the storage of the energy of the pulse has a sense in which the X-ray tube is non-conductive, and then to release the stored energy, to energise the X-ray tube in its conductive sense, the magnitude of the energy applied to the tube being dependent upon the duration of the pulse applied to the tube energising means.

Embodiments of the invention will now be described with reference to the drawings accompanying this Specification in which.

X-ray appliances, particularly portable ones, are known in which the X-ray tube anode voltage is set by a variable ratio transformer via a step-up transformer and the tube current by the filament energisation; the tube rectifies the stepped-up a.c. and operates on only positive-going half cycles of the supply voltage.

Figure 1:
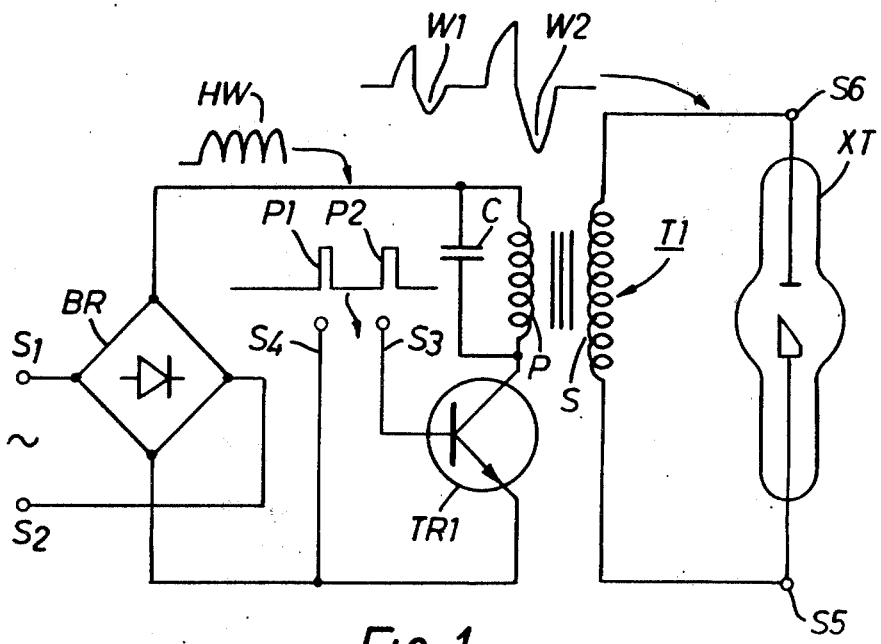
FIG. 1 shows an outline circuit of an energy regulator included in an X-ray power supply.

FIG. 1 shows the general arrangement and the power supply of a portable X-ray unit, embodying the invention, such as is usable for baggage checking and the like security applications and for industrial shadowgraphs. The power requirements for the X-ray tube of such a unit are typically some 800 VA (e.g. 160 KV at 5 mA).

Figure 2:
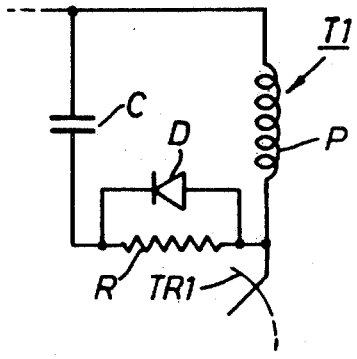
FIG. 2 shows a detail of a practical embodiment of the circuit of FIG. 1.

Referring to FIGS. 1 and 2, the power supply unit includes terminals S1 and S2 for the connection of an alternating supply of, say, 50 or 60 Hz at 110 v or 240 v. A full wave bridge rectifier BR provides a train HW or half-waves, i.e., unidirectional pulses, in known manner. The unidirectional pulses from the rectifier are applied to a circuit formed by the primary P of a transformer T1 in series with the emitter/collector path of a suitable power transistor TR1. The base of the transistor TR1 is connected to a terminal S3 and the emitter thereof is connected to a terminal S4. Control pulses such as P1, P2 are applied by a control circuit CM across the terminals S3 and S4, and the occurrence and duration of each control pulse is determined as described below. The secondary S of the transformer T1 is connected to terminals S5 and S6 to which an X-ray tube XT is connected in operation of the unit. The X-ray tube has the electrical characteristics of a diode.

The circuit of FIG. 1 has two stages of operation as follows:

In the first stage the transistor TR1 is rendered conductive for an interval shortly after the beginning of a unidirectional pulsation HW by a suitable base emitter potential on the terminals S3/S4. During the interval the current in the primary P rises in dependence on its inductance and wave train HW induces a corresponding waveform at the terminals S5/S6 of secondary S. The sense of coupling between the primary and secondary windings is such that this waveform is in the blocking direction of the diode formed by tube XT so current will not flow in the secondary circuit and energy is stored in the magnetic field of the transformer. During the first stage the voltage applied to the X-ray tube XT (in its blocking direction) is set entirely by the supply voltage and the transformer step-up ratio. During this stage the capacitor C is charged under the control of a resistor R (see FIG. 2).

During the second stage, which begins at the end of the conductive interval of the transistor, the current rise in the primary is stopped and the transformer flux begins to collapse and induces a reverse unidirectional pulsation (i.e., in the conductive sense of tube XT) in the secondary circuit, and also renders diode D1 conductive to complete the resonant circuit formed by the primary winding P, the capacitor C and the diode D. By controlling the conductive interval of transistor TR1, set by the control pulses P1, P2, with respect to the half-waves HW, and thus the energy stored in the transformer, the peak value of the waveform W1, W2 subsequently induced in the secondary S can be controlled. The duration of the waveform W1, W2 is controlled by the resonant circuit.

As the peak value of tube energisation voltage determines the quality of the X-radiation from the tube, the operation of tube XT can be regulated by controlling the control pulses P1, P2.

The voltage applied to the tube XT in its conductive direction is determined by the value of the peak current in the primary of the transformer at the end of the first stage and its inductance, and is arranged to be higher than the inverse voltage that was applied in the first stage. In this way the tube can be operated as near as is safe to its maximum rating.

In a practical arrangement, for 50 Hz 240 v operation, each pulse of train HW is 10 milliseconds long. The pulses P1, P2 are timed to commence just after a zero-crossing of the supply waveform and last, selectively, for up to about 5 milliseconds. While a control pulse P1 or P2 endures, the transistor TR1 is conductive and so the current rises in the primary P, and energy is stored in the magnetic field of the primary P. At the end of the control pulse P1, or P2 the current flow through the transistor ceases because it is no longer conductive but the energy stored in the transformer is released and appears as a wave $W_1$, $W_2$ in the secondary circuit. The longer the duration of a control pulse P1 or P2 the greater the energy stored and therefore the greater the amplitude of the subsequent secondary wave W1 or W2. Suitable control circuits CM by which the control pulses P1, P2 can be generated at any desired length, and phase with respect to the supply waveform are well known and will not be described in detail here. An example of such a circuit comprises a Schmitt trigger arranged to trigger a monostable pulsegenerator at each zero-crossing of the rectified A.C.

If the load provided by tube XT can be regarded as a consistent value then the peak voltage produced across the tube by the waves W1 or W2 will depend on the duration of the control pulses P1, P2 as indicated by the differences shown in the FIG. 1 between the control pulses P1, P2 and corresponding waves W1, W2.

Preferably, for use with an X-ray tube the primary P is tuned by capacitor C to a resonant frequency at least twice the supply frequency, e.g. 125 Hz, to cause the waves W1 to last for about 4 milliseconds. This with a maximum of 5 milliseconds for the conductive interval of TR1, leaves time for the 4 millisecond approximate semisinusoid plus its decay tail.

Figure 3:
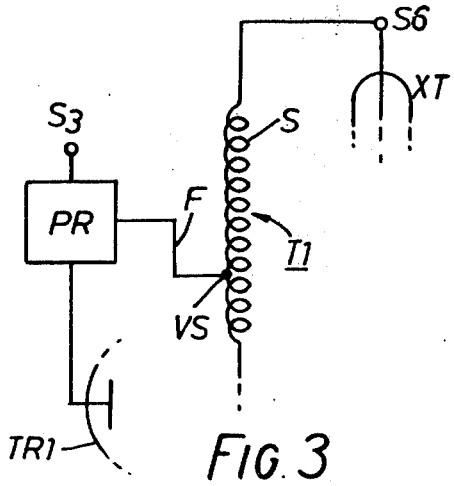
FIG. 3 shows modifications of the circuit of FIGS. 1 and 2.

FIG. 3 shows a further modification in which the voltage in the secondary circuit is sensed, e.g. at a tapping VS on secondary S and a control signal fed back over connection F to a pulse regulator unit PR which can modify the control pulses P1 P2 to maintain a tube operating condition selected by the initial choice of the control pulses P1, P2. The regulator comprises, for example, a peak rectifier which feeds to a comparator a d.c. signal derived from the A.C. at tapping VS. The comparator compares the d.c. signal with a reference signal to produce an error signal. The error signal is used to control the pulse width of the pulses produced by the monostable circuit mentioned hereinbefore.

In summary, it will be appreciated that the exemplary arrangements described above provide three functions. The first function is electronic regulation, conveniently as part of a power supply, of a portable X-ray appliance, thus allowing the exemplary arrangement to be made from relatively light components, avoiding the need for a heavy variable transformer, whilst permitting the peak voltage supply of the tube and thus wavelength of the X-rays to be regulated and automatically stabilised against load and input voltage changes. The pulses of the rectified supply control the operation, avoiding the need for an oscillator, and the losses are low, occuring mainly in the two conductive bridge diodes and the conductive and preferably saturated transistor. Furthermore, as the circuit is provided with electronic control, rather than the electromechanical arrangement required for a variable ratio transformer, a selected value of peak voltage applied to the tube XT can be maintained automatically by feed back.

The second function is that the voltage induced in the secondary S is set by the supply time voltage and the transformer set-up ratio during the first stage of the operation in which the tube XT is non conductive and is lower than the voltage induced in the secondary S during the second stage of operation when the tube XT is conductive thereby achieving the "inverse-suppression" function.

Thirdly, the regulator uses full-wave rectification of the supply rather than the half-wave rectification achieved by a self-rectifying tube and step-up transformer alone, thus balancing the load on the supply by taking power from the supply on every half-cycle.

Although a portable X-ray appliance embodying the invention has been described hereinbefore by way of example, the invention could be embodied in other types of X-ray appliance.

What I claim is:

1. X-ray apparatus comprising an input for receiving AC electrical energy; a rectifier for receiving the AC electrical energy; pulse producing means connected to the rectifier to produce from the unidirectional half-waves of electrical energy supplied thereby unidirectional pulses of electrical energy having controllable durations; control means connected to the pulse producing means to control the durations of the puses; an X-ray tube having the electrical characteristics of a diode; and tube energising means comprising a resonant circuit which is arranged to resonate at a frequency about twice that of the AC electrical energy and which includes a transformer having a primary winding connected to receive the pulses and a secondary winding connected to the X-ray tube, the tube energising means being arranged to store the energy of each pulse in such manner that the voltage applied to the X-ray tube during the storage of the energy of the pulse has a sense in which the X-ray tube is non-conductive, and then to release the stored energy to energise the X-ray tube in its conductive sense, the magnitude of the energy applied to the tube being dependent upon the duration of the pulse applied to the tube energising means.

2. Apparatus according to claim 1, wherein the resonant circuit comprises the primary winding of the transformer and a capacitor in parallel with that winding.

3. Apparatus according to claim 2, wherein the capacitor is in series with a parallel combination of a resistor and a diode, the said capacitor and the said parallel combination being in parallel with the said winding.

4. Apparatus according to claim 3, wherein the rectifier is a full-wave rectifier.

5. Apparatus according to claim 1, wherein the control means comprises an input connected to receive a timing signal derived from the AC electrical energy and is responsive to that timing signal to cause the production of the said pulses to be in predetermined timed relationship to the AC electrical energy.

6. Apparatus according to claim 1, wherein the pulse producing means comprises a transistor, the collector emitter path of which is connected to the energising means, and the base of which is connected to the control means.

7. Apparatus according to claim 1, wherein the control means comprises an input connected to receive a signal indicative of the magnitude of the energy with which the X-ray tube is energised, and is responsive to that signal to vary the durations of the said pulses to maintain that magnitude at a present level.

8. X-ray apparatus including an X-ray generating tube and a circuit for supplying power to said tube to energise it, the circuit comprising rectifier means for rectifying alternating current and a power coupling means for coupling power from said rectifier means to said X-ray tube, said power coupling means including a transformer with one winding connected across the power input terminals of said tube and another winding connected in parallel with a capacitor to form a resonant circuit having a resonant frequency about twice that of the alternating current, switchable means being provided, connected to said resonant circuit and to said rectifier means, to control the flow of the rectified current through the resonant circuit, in accordance with electrical pulses applied to said switchable means, the X-ray tube being unidirectionally conductive and being connected so that energy stored in the resonant circuit generates, in said one winding, a voltage of polarity rendering the tube non-conductive and that energy released from said resonant circuit generates, in said one winding, a voltage of polarity rendering the tube conductive.

9. An X-ray apparatus comprising a rectifier for receiving AC electrical energy of a predetermined frequency to produce unidirectional half-waves of electrical energy, pulse producing means for producing in response to each half-wave a pulse of electrical energy of duration less than the half-wave, control means connected to the pulse producing means to control the duration of the pulse, an X-ray tube having the electrical characteristics of a diode, a resonant circuit having a resonant frequency about twice that of the AC energy, and including a transformer having a primary winding connected to receive the pulse and a secondary winding to which the tube is connected, the circuit having two stages of operation in response to the pulse such that in the first stage the energy of the pulse, which energy is dependent on the duration of the pulse, is stored in the circuit whilst the voltage of the pulse is applied to the tube in its nonconductive sense, and in the second stage the stored energy is released and applied to the tube in its conductive sense.

* * * * *